United States Patent [19]

Amann

[11] Patent Number: 4,901,059

[45] Date of Patent: Feb. 13, 1990

[54] OVERHEAT WARNING FOR WOOD STOVES

[76] Inventor: Matthew J. Amann, 613 N. Ninth St., Gladstone, Mich. 49837

[21] Appl. No.: 290,070

[22] Filed: Dec. 27, 1988

[51] Int. Cl.[4] ..... G08B 17/06

[52] U.S. Cl. ..... 340/594; 340/693

[58] Field of Search ..... 340/594, 593, 693, 584, 340/586, 540

[56] References Cited

U.S. PATENT DOCUMENTS

| | | | |
|---|---|---|---|
| 2,446,794 | 8/1948 | Thornton | 340/586 |
| 2,493,548 | 1/1950 | Proctor | 340/502 |
| 2,807,013 | 9/1957 | Prough et al. | 340/608 |
| 2,982,949 | 5/1961 | Pivetz | 244/12.4 |
| 3,827,039 | 7/1974 | Agense | 340/586 |
| 3,932,849 | 1/1976 | Welch | 340/586 |
| 3,959,787 | 5/1976 | Messmann et al. | 340/585 |
| 4,636,776 | 1/1987 | Leaming | 340/594 |
| 4,712,095 | 12/1987 | Georgis, II | 340/584 |

*Primary Examiner*—Glen R. Swann, III

*Attorney, Agent, or Firm*—Wheeler Law Firm

[57] ABSTRACT

A self-contained electrical warning device for attachment to a wood furnace. Includes a heat sensitive switch, a momentary test switch, a set of batteries, and an alarm. When the furnace reaches a dangerously high temperature, the heat sensitive switch is tripped and the alarm sounds warning the person using the furnace.

4 Claims, 1 Drawing Sheet

OVERHEAT WARNING FOR WOOD STOVES

BACKGROUND OF THE INVENTION

The device of the present invention relates to wood furnaces. Specifically, it relates to warning devices that may be attached to a wood furnace that would activate an alarm notifying the owner that the furnace is overheating.

The use of burning wood to heat a home is old and well known. For example, one of the many achievements for which Ben Franklin is noted was the invention of a superior type of wood burning stove. As other sources of energy, like gas and electric, became available the use of wood burning furnaces decreased. Interest in burning wood to heat a home was renewed as a result of the movement towards energy conservation during the 1970's. A major problem with wood burning furnaces is that of temperature regulation. Without proper regulation of the temperature a wood burning furnace may overheat and present a fire hazard. By means of a unique and simple design the present invention provides the owner of a wood burning furnace the ability to prevent his furnace from overheating.

Although many temperature sensing/warning devices are known, none are known to the inventor that work in the same manner as the inventor's device. For example, U.S. Pat. No. 2,982,949 (Pivetz) discloses a box containing an alarm bell and arm light, however, the invention is designed to be portable rather than secured to a wood furnace and the heat sensitive switch used is of an older design. Furthermore, the invention requires a 110 volt cord to bring in house current, an electric light bulb, a flasher, a thermostatic switch which specifically requires a bi-metallic blade, various insulating blocks which the present invention does not require, and a great deal of other specific structure. Also, the box used in the Pivetz patent is made of plastic rather than metal and does not serve to limit the heat the alarm circuit is exposed to by transferring the heat away from the alarm circuit through the metal of the box. U.S. Pat. No. 2,807,013 (Prough), relates to a heat sensing unit fastened to the flue of a furnace. A warning bell and a transformer are located elsewhere so the entire device is not in a box attached to the furnace. The Prough patent provides that if the flue fails the hot gases are diverted directly into the housing 15 of the arlarm switch. The present invention does not operate in that manner. U.S. Pat. No. 2,493,548 (Proctor) relates to a boiler alarm which responds to the level of liquid and to both high and low pressure in the boiler. The invention in no way relates to wood burning furnaces. U.S. Pat. No. 2,446,794 (Thornton) shows a portable fire alarm which includes a metal box having batteries, a heat sensitive switch, and a buzzer. However, unlike the present invention Thorton is designed to be portable rather permanently fixed to the wood furnace and the heat sensor is internally located. Furthermore, the heat sensor or switch contained within the Thornton invention has its contacts exposed; this may cause the switch to get dirty and fail. The contacts of the heat sensor in the present invention are enclosed. So any dirt that could get into the box through the vents will not cause the contacts to get dirty and fail. U.S. Pat. No. 3,959,787 (Messmann et.al.) relates to a self-enclosed alarm which is intended to respond to a high temperature in a refrigerated container. The sensing unit and the alarm are not contained within the same box. U.S. Pat. No. 3,932,849 (Welch) discloses a heat sensor having a probe which is inserted in food that is to be cooked and notifies the user when the desired temperature has been reached. U.S. Pat. No. 3,827,039 (Agnese) discloses a portable alarm system that is designed to function as both a fire and a burglar alarm. The fire alarm is tripped when a spring loaded fusible element must be destroyed upon attainment of a predetermined temperature. This causes the alarm to trip and the inventor suggests that it may also turn on subsidiary systems such as a room sprinkler. Unlike the present invention the heat sensing element of the Agnese patent is destroyed upon the attainment of a specific temperature where in the present invention the heat sensing element is designed to withstand the heat of the predetermined temperature time after time.

SUMMARY OF THE INVENTION

The purpose of the present invention is to provide a self-contained alarm system that may safely be attached to the wall of the wood furnace to warn against overheating before any danger to the building or its contents so that the furnace damper may be adjusted to reduce the heat.

The basic invention is simple and thus reliable. It consists of a metal box with a loud battery-driven alarm on thhe side away from the furnace. The side toward the furnace has an opening through which a thermostatic switch protrudes so that it is in contact, or nearly in contact with, the surface of the furnace. The same side of the box is provided with adhesive strips to secure the box to the side of the furnace. The adhesive used in such strips can withstand the heat generated by the furnace. Inside the box is a battery holder containing an appropriate number of batteries to drive the warning signals. A simple series circuit connects the batteries to the thermostatic switch which in parallel with the warning siren or other alarm. Also, an outlet is provided on one side of the box for the purpose of hooking up an extension alarm that may be heard in another room within the house. The two alarms, the fixed one and the extension, are wired in parallel with each other.

A test switch is wired in parallel with the thermostatic switch so that the circuit can be tested by momentarily closing the test switch to see if the alarm works. If it does not, the box may be opened to change the batteries. No other failure is likely.

If desired, the thermostatic switch may be of a type that allows adjustment of the temperature at which the switch closes so that the temperature at which the alarm is triggered may be adapted to the particular furnace.

The fact that the enclosure is made of metal is important because it helps to radiate away the heat of the furnace without damage to the batteries inside the closed aluminum box. Also there are openings in the box to allow ventilating air to pass through.

These and other benefits of the present invention will become apparent from the following detailed description thereof taken in conjunction with the accompanying drawings.

DESCRIPTION OF THE DRAWINGS

FIG. number 1 is a schematic diagram showing the relationship of the alarm circuit with the metal box and the wood furnace.

DETAILED DESCRIPTION

Figure 1:
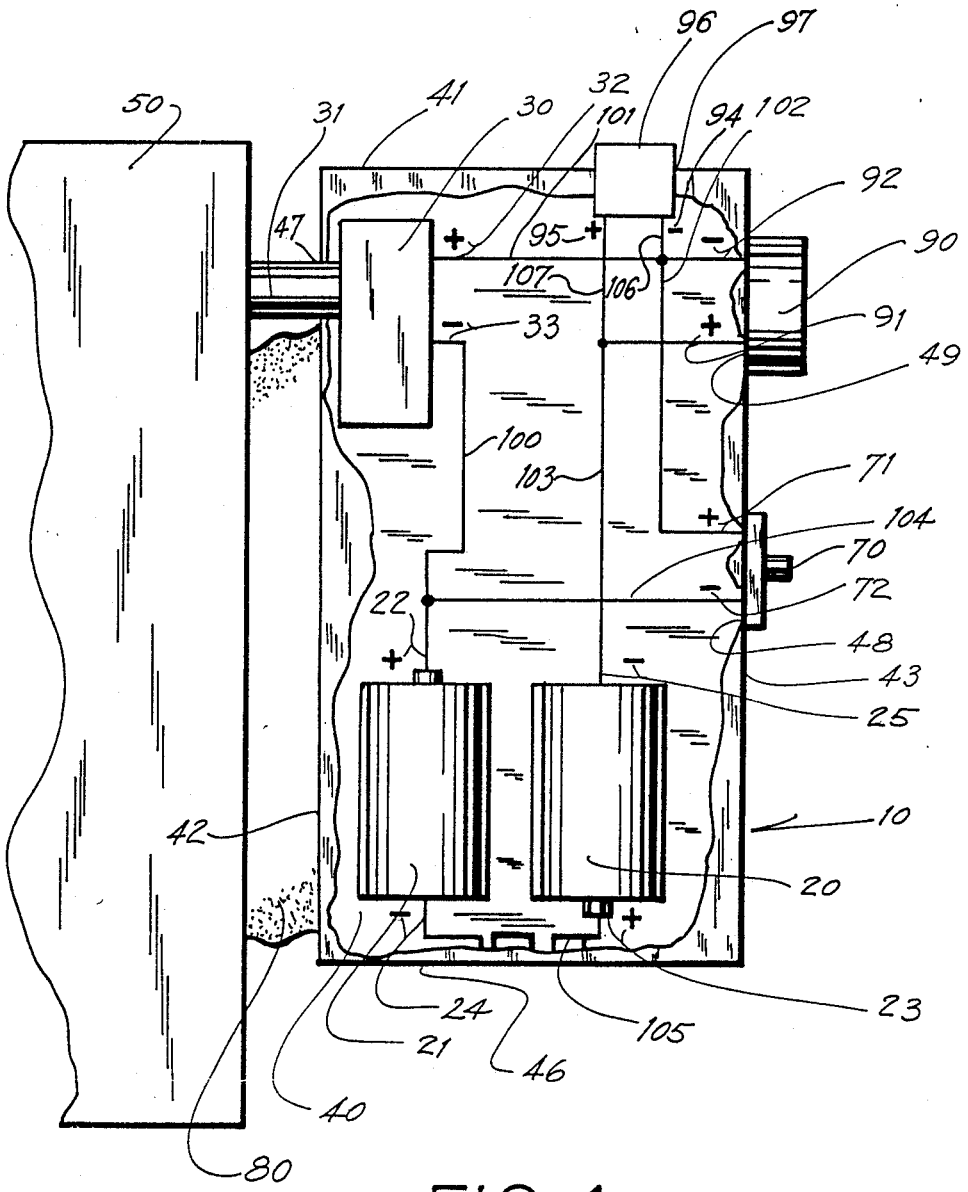

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Referring to FIG. 1, the device of the invention may be seen. The invention is an alarm circuit 10. The alarm circuit 10 is contained inside a metal box 40. The alarm circuit 10 consists of a normally-open thermostatic switch 30, a normally-open momentary-contact switch 70, an electric alarm 90, an alarm outlet 96, a set of batteries 20 and 21, and a series of connecting wires 100–107.

The metal box consists of six sides, of which, four may be seen in FIG. 1. The sides shown in FIG. 1 are the top side 41, the front side 43, the back side 42, and the bottom side 46. Although they are not shown, the left and right sides are vented. The front side 43 contains two openings 48 and 49. The momentary contact switch 70 is attached to metal box 40 through the opening 48. This leaves the switch 70 exposed where the user may easily press it while the terminals 71 and 72 are contained within the metal box. The alarm 90 is attached to the metal box 40 through opening 49. This leaves the buzzer unobstructed while the terminals 91 and 92 are contained within the box 40. The top side 41 has an opening 97. The alarm outlet plug 96 is attached to the alarm circuit 10 through the opening 97. This allows an extension cord to run from the alarm circuit to another buzzer at a different location; e.g. another room. The back side 42 contains a single opening 47. The heat sensitive element 31 of the thermostatic switch 30 passes through the opening 47. This allows the heat sensitive element 31 to have direct contact with the surface of the wood furnace 50.

The elements of the circuit contained within the metal box 40 are connected by a series of wires 100–107. The positive terminal 32 of the thermostatic switch 30 is connected in parallel to the negative terminal 92 of the alarm 90 and the negative terminal 94 of the alarm outlet 96. The positive terminal 71 of the momentary contact switch 70 is connected in parallel to the negative terminal 92 of the alarm 90 and to the negative terminal 94 of the alarm outlet 96 by connecting wires 102 and 106 respectively. The positive terminal 91 of the alarm 90 and the positive terminal 95 of the alarm outlet 96 are connected to the negative terminal of the battery 20 by the wires 103 and 107. The positive terminal of the battery 20 is connected to the negative terminal of the battery 21 by the wire 105. The positive terminal 22 of the battery 21 is connected to the negative terminal 33 of the thermostatic switch 30 by the wire 100. The positive terminal 22 of the battery 21 is also connected to the negative terminal 72 of the test switch 70 by the wire 104. The circuit is complete whenever the momentary test switch 70 or the thermostatic switch 30 is closed. The momentary test switch 70 is only closed when the user or owner of the alarm depresses it to test the alarm circuit 10. The thermostatic switch 30 is closed at a designated temperature by the temperature sensitive element 31 when the temperature of the wood furnace is getting too high, but before it becomes hazardous.

The metal box 40 containing the alarm circuit 10 is preferably attached to the wood furnace 50 by means of a high temperature glue 80. The glue 80 is capable of withstanding the temperatures produced by the wood furnace without degradation to its ability to hold the metal box 40 that contains the alarm circuit 10. The metal box 40, in addition to containing the alarm circuit 10, is important because it helps to radiate the heat of the furnace 50 away from the circuit 10 without damage to the batteries 20 and 21 contained inside of it. The box 40 also has openings not shown to allow ventilating air to pass through it and thereby maintain the temperature at a level that will not damage the circuit 10. The design of the box 40 is such that the batteries 20 and 21 may easily be replaced. The above described embodiments of this invention are merely descriptive of its principles and are not to be limiting. The scope of this invention instead shall be determined from the scope of the following claims, including their equivalents.

What is claimed is:

1. A temperature sensitive alarm circuit consisting of;
- a thermostatic normally open switch,
- said switch having a heat sensitive element;
- an alarm annunciator;
- a self-contained electric power source;
- and a series circuit connecting said switch, said alarm annunciator, and said power source;
- a metal box,
- said metal box containing said switch, said heat sensitive element, said alarm annunciator, and said electric power source,
- said heat sensitive element being exposed outside of said metal box,
- the side of said metal box where said heat sensitive element is exposed being secured to the side of a wood burning furnace,
- whereby said metal box dissipates the heat of wood furnace and prevents the heat from damaging the power source contained inside the metal box,
- the heat from the wood furnace at a specific temperature causing the heat sensitive element to close the thermostatic normally open switch and complete the circuit causing the alarm to sound thereby warning the user of overheating in time so that he may adjust the heat of the furnace before any damage is done.

2. The device of claim 1 in which the series circuit consists of;
- a momentary-contact switch in parallel with said thermostatic switch whereby the user may press the momentary-contact switch to test the alarm circuit; and
- an alarm outlet in parallel with said alarm signal.

3. The device of claim 1 in which the self-contained electric power source is at least one battery.

4. A temperature sensitive alarm circuit that is a series circuit consisting of:
- a thermostatic normally open switch;
- an alarm annunciator; at least one battery;
- a momentary-contact switch; and
- an alarm outlet,
- said momentary-contact switch being wired in parallel with said thermostatic switch,
- said alarm outlet being wired in parallel with said alarm annunciator,
- said thermostatic switch having a heat sensitive element and further comprising,
- a metal box, said metal box containing said other elements;

said heat sensitive element being exposed outside the box, the side of the box where said heat sensitive element is exposed being glued to the side of a wood furnace, at least one side of said box being vented;

whereby said metal box dissipates the heat of the wood furnace and, at a specific temperature, said heat sensitive element causes the thermostatic normally open switch to close and the alarm to sound, the momentary-contact switch allowing the user to test the alarm circuit and the alarm outlet allowing another alarm annunciator to be attached to the alarm circuit.

* * * * *